US005265923A

United States Patent [19]

Paddock

[11] Patent Number: 5,265,923

[45] Date of Patent: Nov. 30, 1993

[54] SYSTEM FOR MOUNTING LOCK-END TUBE ON BURIAL CASKET

[75] Inventor: Lynn E. Paddock, Anniston, Ala.

[73] Assignee: The York Group, Inc., Houston, Tex.

[21] Appl. No.: 960,115

[22] Filed: Oct. 13, 1992

[51] Int. Cl.[5] ..... E05C 9/02

[52] U.S. Cl. ..... 292/336.3; 292/337; 292/DIG. 53

[58] Field of Search ..... 292/251, 337, 347, 336.3, 292/DIG. 53, DIG. 37; 70/370, 451

[56] References Cited

U.S. PATENT DOCUMENTS

| | | | |
|---|---|---|---|
| 2,753,613 | 7/1956 | Baker, Jr. | 292/304 X |
| 3,201,165 | 8/1965 | Trudeau | 292/336.3 |
| 3,623,758 | 11/1971 | Trinca | 292/347 |

*Primary Examiner*—Richard E. Moore
*Attorney, Agent, or Firm*—Synnestvedt & Lechner

[57] ABSTRACT

A lock-end tube for receiving the outer end of a locking rod of a locking apparatus for a casket lid is mounted on a curved end of a round-cornered beveled casket by means of a structure which is positioned in an opening in the curved casket wall and clamped in position by clamping members on each side of the curved wall, these members having confronting end surfaces conforming to the shape of the curved wall.

11 Claims, 3 Drawing Sheets

FIG. 1
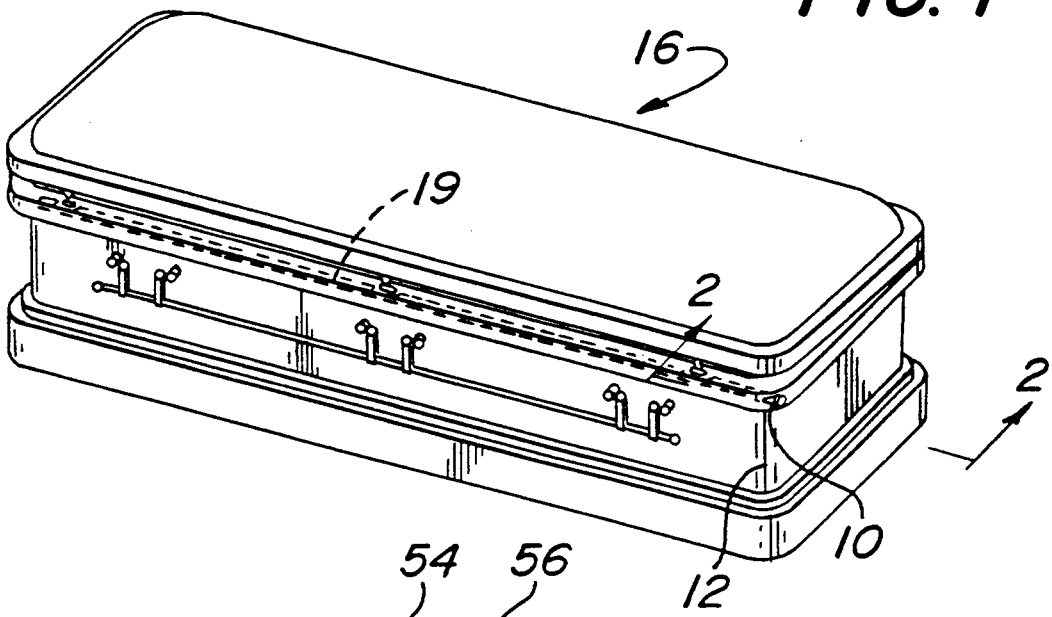
FIG. 3A
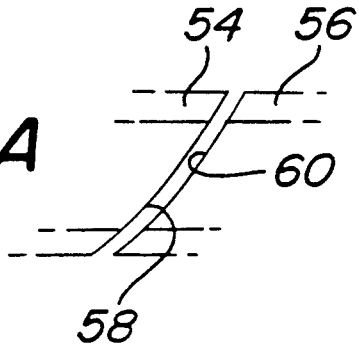
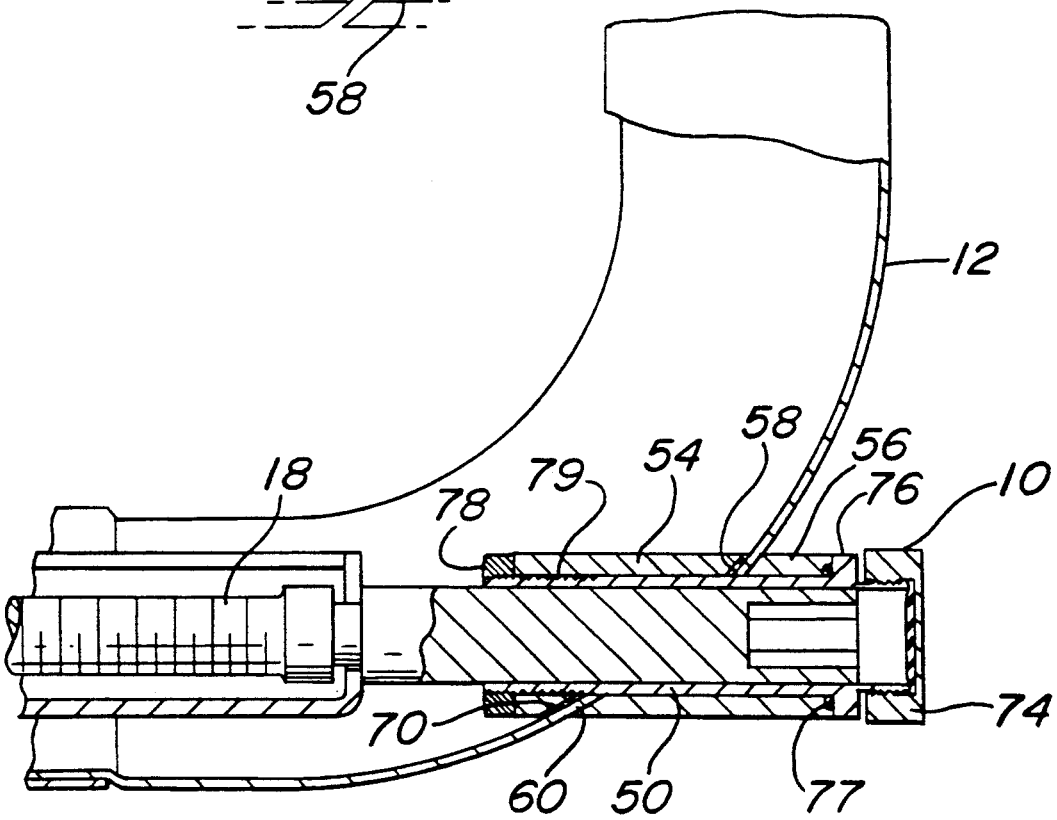
FIG. 3

SYSTEM FOR MOUNTING LOCK-END TUBE ON BURIAL CASKET

FIELD OF THE INVENTION

This invention relates to systems for mounting a lock-end tube on a curved wall of a burial casket.

BACKGROUND OF THE INVENTION

Burial caskets are commonly provided with closable and lockable top lids. The locking system often includes a locking rod which is mounted on the casket body, and which is shifted lengthwise with one of its ends supported in a lock-end tube mounted on and extending through a side wall of the casket body. The rod is shifted by means of a fixed, captured nut into which a portion of the rod is threaded; the end of the rod inside the lock-end tube is provided with a socket into which a crank can be inserted to rotate the rod and thereby move it lengthwise to mate with the end of the rod and turn it. The opposite end of the rod is coupled to a locking bar which is provided with hook-like projections extending therefrom along its length, which enter openings in eyes depending from the casket lid to lock it closed when the bar is shifted longitudinally outwardly by turning of the crank.

When the casket side wall is flat, it is common to employ as the lock-end tube a hollow cylinder having an externally-threaded, reduced-diameter portion and an associated internally-threaded nut; the reduced-diameter portion is inserted through an opening in the casket side wall and the nut is tightened to clamp the portion of the side wall adjacent to the edges of the opening between the nut and the confronting end of the larger-diameter portion of the tube. Before assembly, a gasket can be slipped over the smaller-diameter portion of the tube to assure a good, tight seal when done.

While satisfactory for use on flat casket walls, this system is not satisfactory when the side wall on which it is to be mounted is curved, as is the wall near the end of a round-cornered casket. If applied to such a curved side wall, the opening in the wall will not be adequately closed and sealed by the nut and tube. It has therefore been common in such cases to mount the lock-end tube in an opening through the curved casket side wall by welding it to the surrounding side wall, or by securing it thereto with epoxy cement. This requires a special, time-and-labor intensive step, and results in a final appearance which is unsightly, the lock-end tube and its mounting looking like an afterthought or add-on, rather than an integral part of the casket design.

Accordingly, it is an object of this invention to provide a new and useful lock-end tube structure, mountable on a curved wall of a casket, for receiving an end of a reciprocable rod which is part of a casket-lid locking mechanism.

A further object is to provide such a structure which is easily installed, provides a good seal to the curved side wall, and presents a pleasing final appearance.

SUMMARY OF THE INVENTION

In accordance with the invention, there is provided a lock-end tube structure comprising a central tubular structure for supporting the end of the lock-end rod within it. The central tubular structure is designed to provide a portion which fits in an opening in the curved casket wall, and carries on its exterior an outer assembly for clamping it in fixed position in the wall opening; this outer assembly comprises first and second outer structures, at least one of which is tubular and fits slidably over the exterior of the central tubular structure. The first and second outer structures have respective first and second mutually confronting end surfaces. A first of these confronting surfaces is configured to fit conformingly against one side of the portion of the curved casket wall adjacent to the opening through it, and the other confronting end surface is configured to fit conformingly against the opposite side of the same portion of the casket side wall. The two outer tubular structures are urged toward each other to clamp the above-mentioned adjacent portion of the casket side wall between them, thereby to support the assembly in the aperture in the side wall. Preferably a gasket is placed between the clamped portion of the casket side wall and one of the two confronting end surfaces of the two outer structures to perfect the seal.

In a presently-preferred embodiment wherein the assembly is all of metal, the outer structures are both slidable along the exterior of the central tubular structure; in another embodiment, preferred when the assembly is primarily of plastic material, one of the outer structures is slidable but the other is integral with the central tubular structure.

Also in a preferred embodiment, the two outer structures are urged toward each other by a pair of outboard abutment members each extending radially from the exterior of the central tubular structure, and preferably at least one of these abutment members engages the exterior of the central tubular structure threadingly, so that by screwing it along the central tubular structure the desired clamping action is obtained. In one preferred form of the invention one of the abutment members is an integral, fixed, radial flange on the exterior of the central tubular structure. In another embodiment the separate flange is eliminated, and instead the conforming end face of the integral outer structure provides the abutment function.

In a preferred embodiment, assembly is simply performed by providing an opening of appropriate size in the curved wall of the casket, assembling the lock-end tube structure with the central tubular structure extending through the opening and with one of the abutments positioned on each side of the curved casket wall and outboard of the outer clamping tubes (preferably with a conforming gasket lying against the inside of the curved wall), and then providing relative closing motion of the abutments, toward each other, to clamp the curved side wall and gasket between the confronting end surfaces of the two outer clamping structures. A cap may then be screwed onto the exterior end of the central tube to seal it. No welding or cementing is required to mount the lock-end tube, and the assembly has a smooth, finished appearance.

BRIEF DESCRIPTION OF FIGURES

These and other objects and features of the invention will be more readily understood from a consideration of the following detailed description, taken with the accompanying drawings, in which:

FIG. 1 is a perspective view of a round-cornered casket with a lock-end tube according to the invention mounted at one corner;

FIG. 3 is an enlarged fragmentary horizontal sectional view taken along 3—3 of FIG. 2;

FIG. 3A is a schematic view of the confronting faces of the two clamping tubes, to show more clearly their conforming, confronting end surfaces;

DETAILED DESCRIPTION OF SPECIFIC EMBODIMENTS

Figure 2:
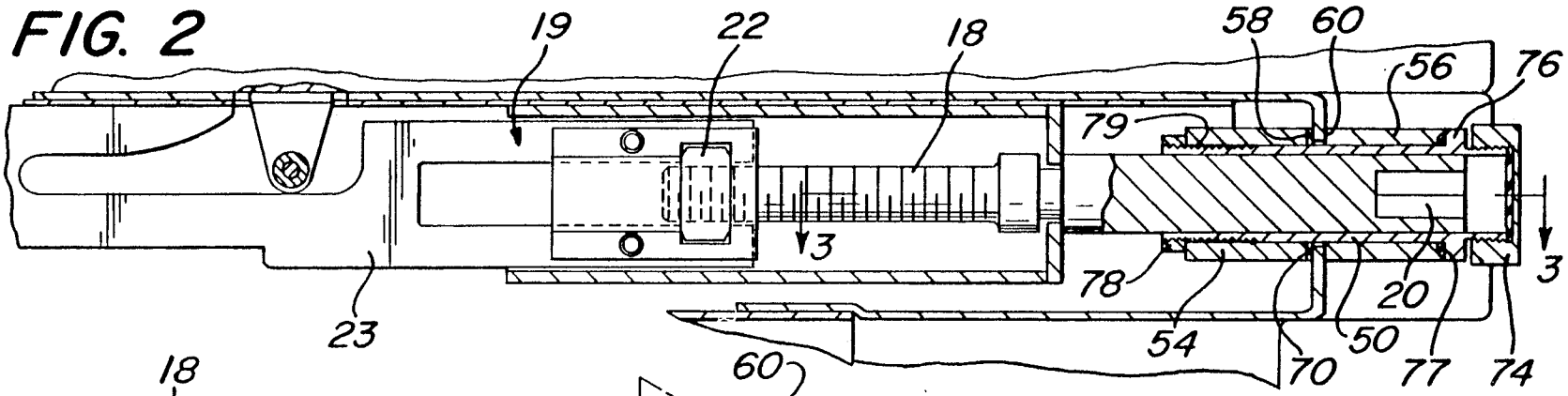
FIG. 2 is an enlarged fragmentary sectional view taken on line 2—2 of FIG. 1, showing one preferred embodiment of the invention.

Referring now to the specific embodiments of the invention shown in the drawings by way of example only, FIG. 1 shows a lock-end tube 10 mounted on a curved wall 12 located at one end of a round-cornered burial casket 16, for receiving the rod 18 (FIG. 2) of the conventional casket lid-locking apparatus 19 which extends along the edge of the casket lid.

The exposed end of rod 18 contains an Allen head socket 20, into which a crank (not shown) having an Allen head outer surface at its tip can be inserted and rotated to turn rod 18 in either direction. The opposite end of rod 18 engages the threads of a captured nut 22, which cooperates to move the locking bar 23 forward or back, to lock and unlock the casket lid. Since such locking arrangements are known in the art, and the invention is concerned primarily with the lock-end tube mounting, it need not be described here in further detail.

The lock-end tube structure of the invention, in the presently preferred embodiment of FIGS. 1-4, comprises a central tube 50 of metal having on its exterior a pair of axially slidable outer clamping tubes 54 and 56 also of metal, the respective confronting end surfaces 58 and 60 of which are specially configured so that the end surface 58 fits conformingly against the inner side of the portion of the curved casket wall surrounding the opening in the casket wall, while surface 60 is specially configured to fit conformingly against the outer side of the same portion of the curved casket wall. In this example it is assumed that the curvature of the casket wall is only around one axis, and is substantially circular, but curvatures about more than one axis and other than circular can be used, so long as the confronting surfaces of the outer tubular sections match and conform to the wall configuration. Preferably a gasket 70 is placed between the interior of the curved wall and the end surface 58 to effect a good seal. A knurled cap nut 74 is screwed onto the threaded outer end of the central tube to seal it closed, and an integral flange 76 serving as an abutment for clamping tube 56 extends radially outward from the central tube near its outer end, to provide a fixed abutment. A resilient 0-ring 77 is preferably positioned between tube 56 and flange 76 to provide a suitable seal, and a nut 78 engages the threaded end portion 79 of tube 50.

In use, the components of the lock-end tube assembly are assembled in the position shown, and the nut 78 is tightened to clamp the portion of the casket side walls 81 adjacent the opening between the two confronting and conforming faces of the clamping tubes 54 and 56, with a gasket 70 positioned between clamping tube 54 and the inner wall of the casket; the cap nut 74 is then applied.

The resultant mounting is gas-tight, uses parts which are easy and inexpensive to make and assemble, and provides a finished appearance.

Figure 4:
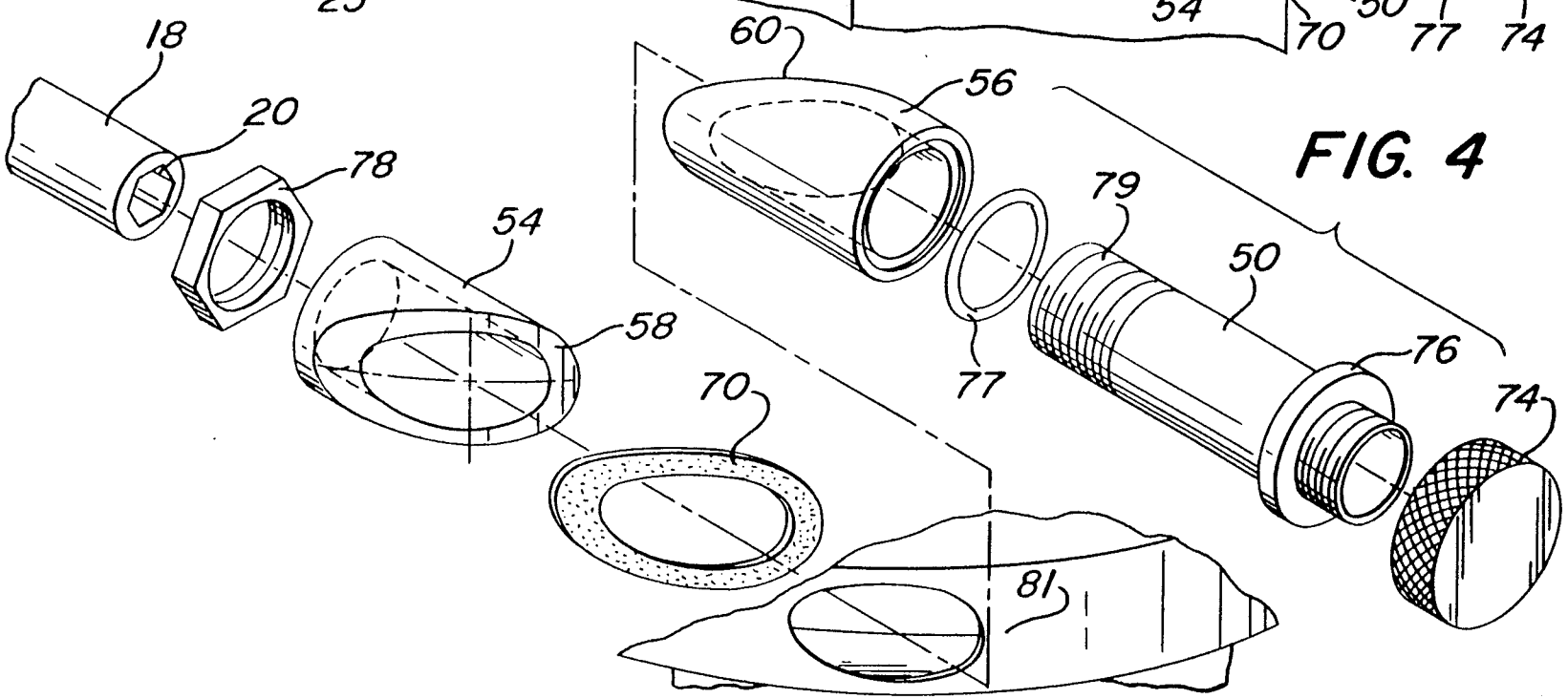
FIG. 4 is an exploded perspective view showing the parts of the embodiment of FIG. 2 separated from each other along their common longitudinal axis.
Figure 5:
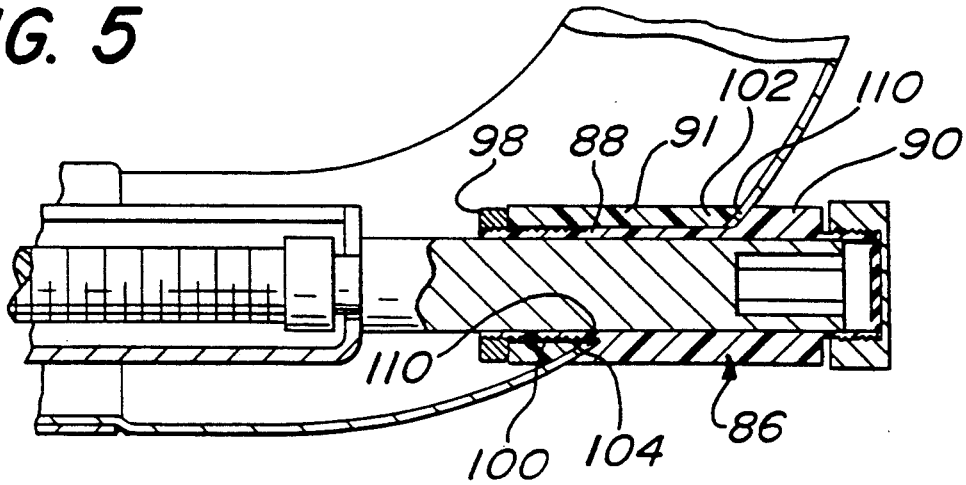
FIG. 5 is an enlarged fragmentary horizontal sectional view of a corner of the casket of FIG. 1 with another preferred embodiment of the invention installed therein.
Figure 6:
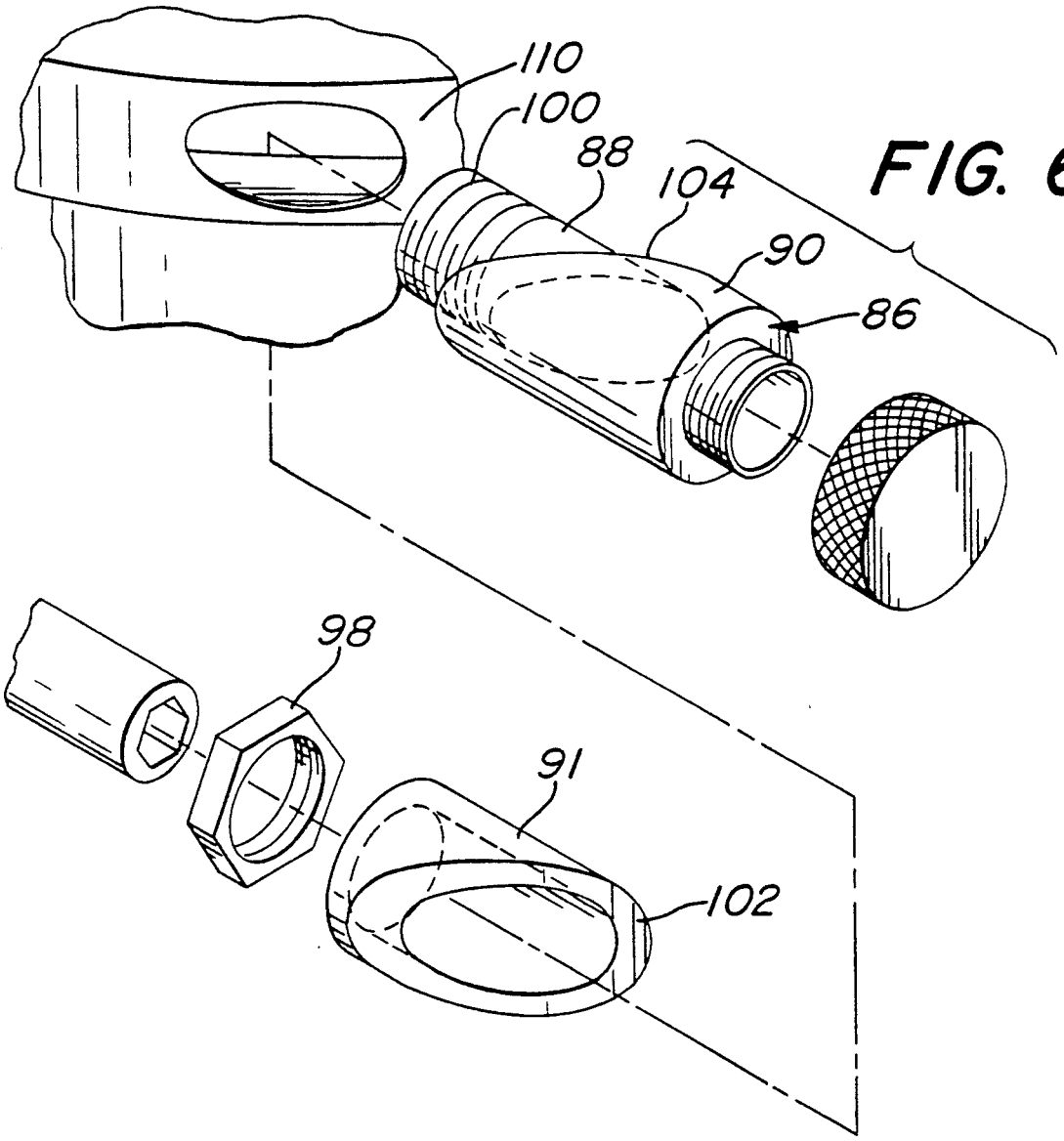
FIG. 6 is an exploded perspective view of the lock-end tube support system of FIG. 5.

The embodiment of FIGS. 5 and 6 is preferred when the central tubular structure and the external structures are of a plastic material. In this embodiment, a central tubular structure 86 of plastic material is employed which includes a central tubular portion 88 which is threaded at both ends and an integral exterior clamping structure 90, which has a configuration similar to slidable clamping tube 56 of FIG. 4, but is of a piece with the central tube structure. Slidable clamping tube 91 is preferably also of plastic and fits slidably over the cylindrical portion 88 of central tubular structure 86. In this embodiment the flange 76 of FIG. 3 is not required, since the clamping structure 90 is integral with the central tubular structure 86. A clamping nut 98 engages threads 100 on the end of central tubular portion 88 so that when the nut is advanced by turning it, it urges clamping tube 91 toward the confronting end of integral clamping structure 90. Confronting surfaces 102 and 104 of clamping tube 91 and clamping structure 90 conform to the shapes of the opposite sides of the portion of the casket wall 110 which is clamped between them. The gasket 70 of FIG. 4 is generally not necessary when the structures 90 and 91 are of plastic, as in this embodiment. Assembly is substantially the same as for the earlier-described embodiment of FIG. 4.

While the invention has been described with particular reference to specific embodiments in the interest of complete definiteness, it will be understood that it may be embodied in a variety of forms diverse from those specifically shown and described, without departing from the spirit and scope of the invention.

What is claimed is:

1. A lock-end tube assembly for mounting in an opening in a curved wall of a burial casket to hold one end of a rod-like member extending from the locking mechanism of said casket, comprising:

a central tubular structure for receiving said rod-like member slidingly within it;

at least one end of said central tubular structure being of a size to fit through said opening;

a pair of outer structures on the exterior of said central tubular structure, at least one of said outer structures being slidable along said exterior of said central tubular structure;

said outer structures having mutually-confronting end surfaces, one curved to conform to the configuration of the outside of said curved wall around said opening, and the other curved to conform to the configuration of the inside of said curved wall around said opening; and screw-threaded clamping means mounted on said central tube structure and operable to urge said confronting surfaces toward each other thereby to clamp the portion of said curved wall adjacent to said opening between said confronting surfaces.

2. The assembly of claim 1, wherein both of said outer structures are slidable along said exterior of said control tubular structure.

3. The assembly of claim 2, wherein said central tubular structure comprises an integral flange extending outwardly near an end thereof and a screw-threaded portion on its exterior adjacent to its opposite end; said outer structures are disposed between said flange and said screw-threaded portion; and said screw-threaded clamping means comprises a member threadingly engaging said threaded portion of said central tubular structure for urging said confronting surfaces toward each other with said portion of said curved wall between them.

4. The assembly of claim 1, wherein one of said outer structures is an integral extension of said central tubular structure.

5. The assembly of claim 4, wherein said central structure comprises an externally screw-threaded portion and said screw-threaded clamping means comprises a threaded member engaging said threaded portion of said central tubular structure to urge said confronting surfaces toward each other with said curved portion of said curved wall between them.

6. A lock-end tube assembly for mounting in an opening in a curved wall of a burial casket to hold one end of a rod-like member extending from the locking mechanism of said casket, comprising:

a central tube, one end of which is threaded and of a size to fit through said opening;

a pair of outer clamping tubes axially slidable on the exterior of said central tube and having a pair of mutually-conforming, confronting, end surfaces, one of said end surfaces conforming to the configuration of the outside of said curved wall around said opening and the other of said end surfaces conforming to the configuration of the inside of said curved wall around said opening; and means secured to said central tube operable to urge said confronting surfaces toward each other, to permit the portion of said curved wall adjacent to said opening to be clamped between said confronting surfaces.

7. A lock-end tube system mountable on a curved wall of a burial casket to receive one end of the barrel of a casket-lid locking mechanism, comprising:

a central tube for supporting within it said barrel end, and an outer tube assembly for holding said central tube in fixed position in an opening in said curved casket wall;

said outer tube assembly comprising first and second outer clamping tubes fitting slidably over and about the exterior of said central tube and having mutually confronting end surfaces, one of said surfaces being configured to fit conformingly against one side of a portion said curved casket wall adjacent to said opening and the other of said end surfaces being configured to fit conformingly against the opposite side of said portion of said curved casket wall; and clamping means acting between said central tube and each of said outer clamping tubes for urging said outer tubular sections toward each other with said portion of said curved casket wall between said confronting surfaces thereof, to support said central tube in said aperture.

8. The system of claim 7, comprising a sealing gasket between one of said confronting end surfaces and said portion of said curved casket wall.

9. The system of claim 7, wherein said central tube comprises a circular flange extending around its circumference adjacent an end of one of said outer clamping tubes opposite from its confronting surface.

10. The system of claim 7, wherein said clamping means comprises a first abutment member secured to said central tube and extending radially therefrom at that end of said one of said outer clamping tubes which is opposite from its confronting end surface, and a second abutment member secured to said central tube and extending radially therefrom at that end of said other outer clamping tube which is opposite from said confronting surface thereof; at least one of said first and second abutment means threadingly engaging the exterior of said central tube so that by turning said at least one abutment means said portion of said curved casket wall is clamped between said first and second abutment members.

11. The system of claim 10, wherein the other of said first and second abutment means comprises a fixed flange on said central tube.

* * * * *